US008760358B2

(12) United States Patent
Bouguereau et al.

(10) Patent No.: US 8,760,358 B2
(45) Date of Patent: Jun. 24, 2014

(54) RADIO WAVE TRANSMITTING DEVICE, ANTENNA AND SPACECRAFT

(75) Inventors: Jean-Luc Bouguereau, Plaisance du Touch (FR); Fabien Calmettes-Carensac, Cugnaux (FR)

(73) Assignee: Thales, Neuilly sur Seine (FR)

( * ) Notice: Subject to any disclaimer, the term of this patent is extended or adjusted under 35 U.S.C. 154(b) by 358 days.

(21) Appl. No.: 13/283,350

(22) Filed: Oct. 27, 2011

(65) Prior Publication Data

US 2012/0274533 A1 Nov. 1, 2012

(30) Foreign Application Priority Data

Oct. 29, 2010 (FR) ..... 10 04272

(51) Int. Cl.
*H01Q 1/42* (2006.01)

(52) U.S. Cl.
USPC ..... 343/872; 343/834; 343/912

(58) Field of Classification Search
USPC ..... 343/834, 872, 840, 912, 916
See application file for complete search history.

(56) References Cited

U.S. PATENT DOCUMENTS

| | | | | |
|---|---|---|---|---|
| 3,388,401 | A | 6/1968 | Weir | |
| 4,126,864 | A | 11/1978 | Hopkins | |
| 4,364,053 | A * | 12/1982 | Hotine | 343/915 |
| 4,918,459 | A | 4/1990 | De Teso | |
| 5,729,241 | A * | 3/1998 | Ergen et al. | 343/872 |
| 6,064,344 | A * | 5/2000 | Walton | 343/704 |
| 6,137,449 | A * | 10/2000 | Kildal | 343/781 P |

FOREIGN PATENT DOCUMENTS

GB 2277200 A1 10/1994

* cited by examiner

*Primary Examiner* — Tan Ho
(74) *Attorney, Agent, or Firm* — Baker Hostetler LLP

(57) ABSTRACT

A device for transmitting radio waves comprises an item of transmitting equipment for a telecommunications antenna, a membrane for thermally protecting the reflector, and means for attaching the thermal protection membrane to the item of equipment. The thermal protection membrane is furnished with a plurality of elastic tensioners designed to keep the thermal protection membrane stretched between a first active face of the item of transmitting equipment and space, irrespective of the thermal expansions of the membrane. The item of transmitting equipment occurs in a predetermined temperature range when the attachment means attach the membrane to the item of transmitting equipment.

13 Claims, 3 Drawing Sheets

RADIO WAVE TRANSMITTING DEVICE, ANTENNA AND SPACECRAFT

CROSS-REFERENCE TO RELATED APPLICATION

This application claims priority to foreign French patent application No. FR 1004272, filed on Oct. 29, 2010, the disclosure of which is incorporated by reference in its entirety.

FIELD OF THE INVENTION

The field of the invention is that of telecommunications antennas designed to transmit radio waves. These antennas are used on earth or in space or they are on board telecommunications satellites. Radio radiation is conventionally transmitted by a source coupled to one or more reflectors or else only by a radiating panel transmitting the radio radiation directly into space.

BACKGROUND

An attempt is usually made to minimize the thermoelastic deformations of the reflector or of the radiating panel in order to ensure stability of the directivity of the antenna. The thermoelastic deformations of the reflector or of the radiating panel originate from the cyclical thermal variations caused by passing in alternation through zones of shadow and zones of exposure to the solar rays.

In the rest of the text, item of transmitting equipment means the reflector or the radiating panel.

A thermal protection membrane is usually placed between an active face of the item of transmitting equipment and space in order to thermally insulate the item of transmitting equipment and limit the thermoelastic deformations. More particularly, these are multi-layer protective membranes comprising a stack of polyimide layers. The polyimide used is well known to those skilled in the art; it involves, for example, a layer of Kapton® (a brand of polyimide film registered to E. I. Du Pont de Nemours and Company) in which Germanium is deposited. This insulation is extremely light. Moreover, this insulation has the advantage of being generally transparent to the radio waves.

When the membrane is installed on a reflector, attempts are made to prevent the membrane sticking to the concave reflecting face of the reflector in order to prevent damage to the reflector because of the aerodynamic flows that heat its surface. When the membrane sticks to the concave face of the reflector, the Germanium focuses the solar rays, which has the effect of damaging the elements that are in the path of a ray reflected by the concave reflecting surface of the reflector such as, for example, a radiofrequency source or else a secondary reflector.

Usually the membrane is stretched between the concave face of the reflector or of the radiating panel and space and the periphery of the membrane is attached to the edge of the reflector separating the active surface from the inactive surface of the reflector or of the panel.

Because of their design in different materials, the membrane and the item of transmitting equipment sustain different expansions/retractions when the temperature varies.

This solution does not guarantee a permanent tension of the membrane because the antenna is subjected to temperature variations.

Moreover, at high frequency (Ka band), the Kapton® is not totally transparent to the radio waves. The membrane therefore induces phase shifts on the radiation reflected by a reflector or radiated by the radiating panel. The value of the phase shift depends on the positioning of the membrane relative to the active surface transmitting, that is to say reflecting or radiating, the radio waves.

Attempts are made to keep the membrane permanently stretched between the item of transmitting equipment and space so that the phase shift induced by the membrane is always the same.

There is a solution for ensuring a permanent tension of the membrane 1. This solution is shown in FIGS. 1*a* and 1*b* in the case of a dual-grid reflector, that is to say a reflector 2 comprising two individual reflectors 7, 9. It is based on the use of tensioners. Tensioners 6 are distributed evenly over the periphery of the reflector and are attached to the structure 5 connecting the two individual reflectors, that is to say separating the active-surface face 3 from the inactive surface 4 of the reflector. During the operation of attaching the membrane 1 to the reflector 2 using attachment means 8, the tensioners are folded in a U-shape between the membrane and the edge 5 of the reflector 2 so that they apply a force $\vec{E}$ to the membrane towards the outside of the reflector which permanently stretches the membrane like a drum skin between the active face and space.

However, this solution involves a prolonged immobilization of the reflector when the tensioners are installed before the membrane is attached thereto.

Moreover, the operation of attaching the membrane to the reflector is complex and difficult to reproduce. During this operation, it is necessary not only to ensure that the tensioners are folded in a U-shape, but also that the folding is such that the membrane can be stretched like a drum skin.

Furthermore, this solution can be installed only on dual-grid reflectors; it cannot be installed on single reflectors or on radiating panels because the edge of these items of equipment separating the active surface from the inactive surface does not provide a smooth surface for the bonding.

One object of the present invention is to alleviate the aforementioned drawbacks.

Furthermore, this solution is bulky and fragile. The tensioners that are folded in a U-shape occupy a considerable space on the periphery of the reflector and the merest impact can unstick them or break them.

Another object of the invention is to remedy this drawback.

SUMMARY OF THE INVENTION

Accordingly, the subject of the invention is a device for transmitting radio waves comprising an item of transmitting equipment for a telecommunications antenna, a membrane for thermally protecting the reflector and means for attaching the thermal protection membrane to the item of equipment, the said thermal protection membrane being furnished with a plurality of elastic tensioners designed to keep the thermal protection membrane stretched between a first active face of the item of transmitting equipment and space, irrespective of the thermal expansions of the membrane and the item of transmitting equipment occurring in a predetermined temperature range when the attachment means attach the membrane to the said item of transmitting equipment.

Advantageously, the predetermined temperature range extends from −250° C. to +400° C.

Advantageously, the means for attaching the membrane comprise first attachment means secured to the membrane ensuring separation between the tensioners and the edge of the membrane in order to ensure contact between the item of transmitting equipment and the tensioners when the attachment means attach the membrane to the said item of transmitting equipment.

Advantageously, the attachment means comprise second attachment means attached to a second inactive face of the item of transmitting equipment and are designed to interact with the first attachment means in order to attach the membrane to the item of transmitting equipment.

Advantageously, the elastic tensioners comprise flexible strips that are stiffer than the stiffness of the membrane.

Advantageously, the flexible strips have a stiffness of between 5 N/m and 500 N/m.

Advantageously, the flexible strips are made of polyparaphenylene terephthalamide PPD-T or of polyimide.

Advantageously, the flexible strips have a thickness of between 0.1 mm and 2 mm.

Advantageously, the flexible strips are Kapton® brand polyimide film strips that are 10 to 20 times thicker than the membrane.

Advantageously, the flexible strips are arranged so that they overlap on the joint between a second inactive face of the panel and an edge of the item of transmitting equipment joining the first active face and the second inactive face when the attachment means attach the membrane to the said item of transmitting equipment, the strips also being designed so that they are in flexion over the whole predetermined temperature range.

Advantageously, the flexible strips are flattened against the membrane.

Advantageously, the elastic tensioners are arranged so as to exert an additional force on the membrane in the direction perpendicular to the force and in the direction of space so as to keep the membrane spaced from the first active face of the item of transmitting equipment at every point of the said first active face.

Advantageously, the item of transmitting equipment is a reflector.

Advantageously, the reflector is parabolic.

Advantageously, the item of transmitting equipment is a radiating panel.

Advantageously, the first active face is concave.

Advantageously, the first active face is flat.

A further subject of the invention is an antenna comprising a device according to the invention.

A further subject of the invention is a spacecraft comprising an antenna according to the invention.

Finally, the subject of the invention is a method for manufacturing a device for reflecting radio waves according to the invention comprising: a step consisting in fitting the membrane with elastic tensioners designed to hold the membrane stretched between the first face of the item of transmitting equipment and space, irrespective of the thermal expansions of the membrane and of the item of transmitting equipment that occur in a predetermined temperature range, when the attachment means attach the membrane to the said item of transmitting equipment; and a step of attaching the membrane furnished with the elastic tensioners to the item of transmitting equipment.

Because the tensioners are attached to the membrane, the proposed solution makes it possible to minimize the time of immobilization of the item of transmitting equipment that must be available in order to undergo many tests before it is sent into space. It also makes it possible to ensure a permanent stretching of the membrane.

Moreover, it does not take up much space and is sturdy.

Moreover, during the preparation of the antenna before it is sent into space, the antenna is subjected to various tests which lead to installing the membrane and removing it several times from the item of transmitting equipment. The proposed solution makes it possible to obtain reproducibility of the mounting of the membrane on the item of transmitting equipment. In other words, it makes it possible to ensure the same positioning of the membrane on the item of transmitting equipment with each new installation. The interferences induced by the membrane on the radiation transmitted by the membrane are always the same throughout the service life of the antenna on the ground.

BRIEF DESCRIPTION OF THE DRAWINGS

Other features and advantages of the invention will become evident on reading the following detailed description made as a non-limiting example and with reference to the appended drawings in which.

From one figure to another, the same elements are identified by the same reference numbers.

DETAILED DESCRIPTION

Figure 1A:
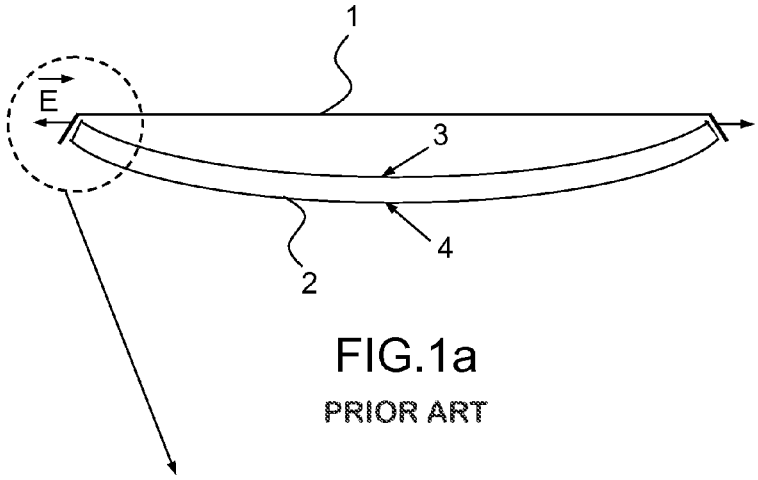
FIG.1a PRIOR ART
FIGS. 1*a* and 1*b* already described represent schematically in section a reflector furnished with a membrane according to the prior art and, respectively, a detail of the arrangement of the tensioners on the periphery of the reflector.
Figure 1B:
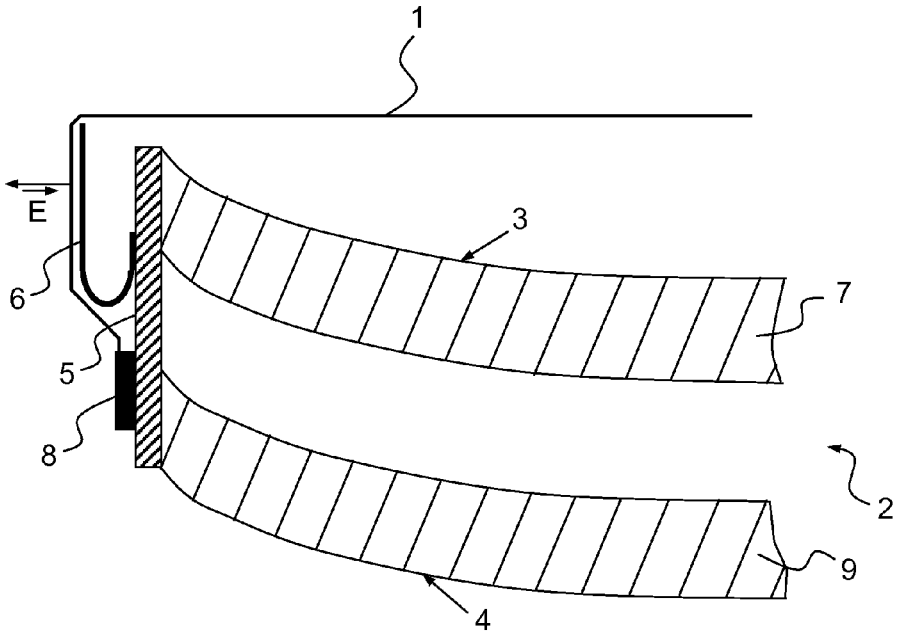
FIG.1b PRIOR ART
Figure 2A:
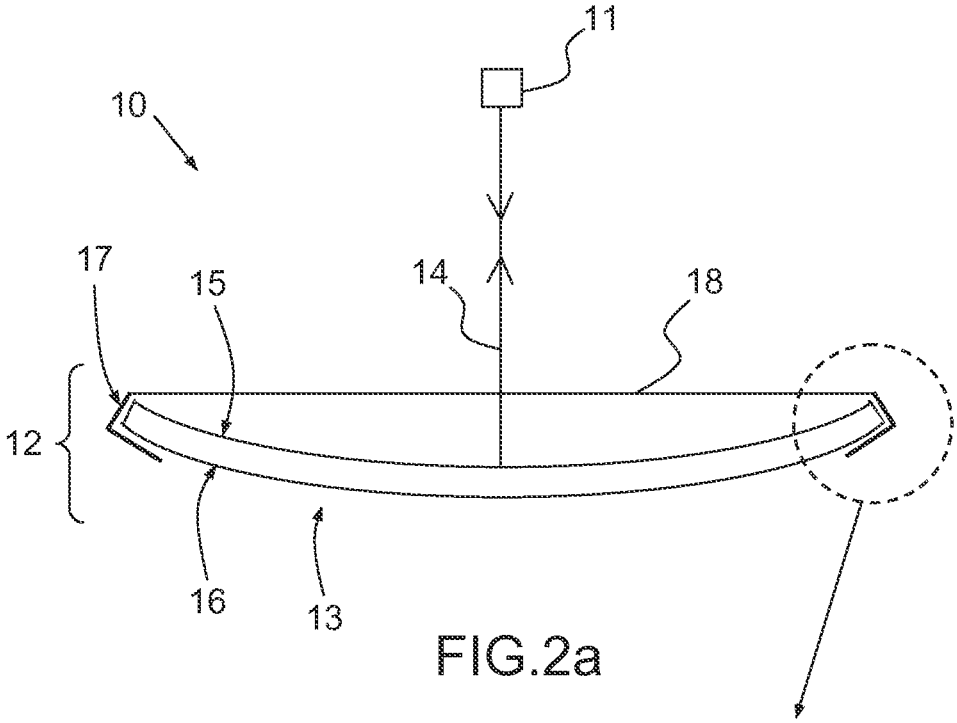
FIGS. 2*a* and 2*b* represent schematically in section an antenna according to the invention and respectively a detail of a first exemplary arrangement of the tensioners on the periphery of a reflector of the transmitting device according to the invention.
Figure 2B:
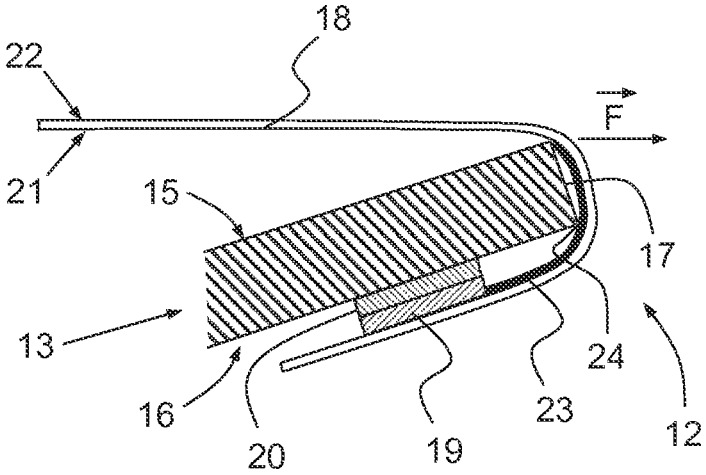

FIGS. 2*a* and 2*b* show a section of a telecommunications antenna 10 according to the invention comprising a source 11 positioned at the focus point of a device 12 for transmitting radio waves according to the invention. This device 12 comprises a reflector 13 on which radio waves are intended to be reflected from the source.

As a variant, the source may be replaced by a receiver. The waves are then reflected to the receiver.

The telecommunications antenna may be designed for space or earth applications.

The reflector 13 comprises a first active face 15 and a second inactive face 16. These faces are, in the embodiment of FIG. 2*a*, substantially parallel. The first face 15 and the second face 16 are joined together via an edge 17 extending continuously on the periphery of the two faces 15, 16. A membrane separates the first face 15 from space.

In the embodiments of the figures, the reflector is parabolic. The first active face 15 is concave. In the embodiment of FIG. 2*a*, the second face 16 is convex.

Finally, the reflector is single; it consists of a single individual reflector. The invention also applies to dual-grid reflectors comprising two individual reflectors placed one behind the other as described above. In this case, the first face belongs to a first individual reflector and the second face belongs to a second individual reflector.

The device for reflecting radio waves also comprises a membrane 18 for thermally protecting the reflector 13 and means 19, 20 for attaching the thermal protection membrane 18 to the reflector 13.

The membrane 18 is a multi-layer protection membrane comprising a stack of polyimide layers. The polyimide used is well known to those skilled in the art; it is for example a film of Germanized Kapton® (Kapton® with a germanium deposit) developed by the company DuPont de Nemours.

Thermal protection membranes are chosen that are transparent to the electromagnetic waves over the whole range of frequencies used in space telecommunications.

The thermal protection membranes conventionally have a thickness of between 0.025 mm and 0.2 mm (an assembly of Kapton® sheets and separators) and a modulus of elasticity of between 2 GPa and 2.5 GPa. The modulus of elasticity depends on the temperature.

The membrane 18 separates the first face 15 of the reflector 13 from space so as to provide the thermal protection of the reflector 13. In other words, every point on the first face 15 is separated from space by the membrane 18. The dimensions of the membrane are chosen depending on this condition. Moreover, the dimensions of the membrane 18 are chosen to make it possible to ensure the attachment of the membrane 18 to the second face 16 of the latter using the attachment means 19, 20.

The means for attaching the membrane comprise first attachment means 19 secured to the membrane 18. The first attachment means 19 are attached to the periphery of the inner face 21 of the membrane 18.

The inner face 21 is the face of the membrane 18 that is intended to face the reflector 13 and the outer face 22 of the membrane 18 is the face of the membrane that is designed to be oriented towards space.

The first attachment means are designed to interact with the reflector 13 in order to attach the membrane to the reflector.

More particularly, the first attachment means 19 are designed to interact with the second face 16 of the reflector.

The attachment means are capable of attaching the membrane to the reflector removably but it would also be possible to use permanent attachment means.

Advantageously, the attachment means also comprise second attachment means 20 secured to the reflector. They are attached to the periphery of the inner face of the membrane 18. In the embodiments of the figures, the second attachment means are attached to the second face 16 (FIG. 2*b*). The first attachment means 19 are designed to interact with the second attachment means 20 in order to attach the membrane 18 to the reflector 13. They involve, for example, hook-and-loop coupling means. Such coupling means are, for example, marketed under the Velcro® name.

The membrane 18 is furnished with a plurality of elastic tensioners 23, shown as a bold line in FIG. 2*a*, designed to hold the membrane 18 in a stretched manner between the first face 15 of the reflector and space, irrespective of the thermal expansions of the membrane 18 and of the reflector 13 that occur in a predetermined temperature range, when the attachment means 19, 20 attach the membrane to the reflector.

The membrane then forms a substantially flat surface between the first face of the reflector and space.

The thermal protection membrane 18 is furnished with a plurality of elastic tensioners 23 designed to create a force $\vec{F}$ which pulls the membrane 18 towards the outside of the reflector 13, that is to say towards space, when the membrane is attached to the reflector, so that the membrane forms a substantially flat surface between the first face 15 of the reflector 13 and space, irrespective of the thermal expansions of the membrane 18 and of the reflector 13 that occur in a predetermined temperature range.

In other words, the elastic tensioners have dimensions and are arranged so as to stretch the membrane like a drum skin between the first face of the reflector 15 and space.

Because of their elasticity, the tensioners take up the clearances due to the differential thermo-elastic expansions and contractions between the reflector and the membrane when the temperature varies in order to keep the membrane permanently stretched.

This solution has the advantage of stretching the membrane in a temperature range that is chosen depending on the conditions of use of the membrane and of the reflector which makes it possible to get around the solar focusing problems described above. Moreover, because the membrane is kept permanently stretched, the influence of the membrane on the performance of the reflection device is the same whatever the temperature. Moreover, coupling the tensioners to the membrane avoids unnecessarily immobilizing the reflector in order to attach thereto the tensioners individually on the reflector before attaching the membrane thereto. The reflector is immobilized only during the operation for attaching the membrane.

The temperature range chosen depends on the applications. For space applications, a temperature range is chosen that extends from −250° C. to +350° C. This temperature range corresponds to the temperature range to which the protective membrane of a telecommunications antenna sent into space is likely to be subjected. The elastic tensioners 23 are arranged on the periphery of the membrane. Advantageously they are attached to the inner face 21 of the membrane.

Attaching the elastic tensioners 23 to the inner face 21 of the membrane limits the risks of separation of the tensioner. The forces are applied by the tensioners to the membrane in order to keep it stretched. These forces are not absorbed by the means for attaching the tensioner to the membrane because they are oriented perpendicularly.

The elastic tensioners 23 are secured to the membrane.

The elastic tensioners 23 are attached to the membrane 18, for example, by means of an adhesive, such as, for example, glue or an adhesive strip or by any other means for attaching the tensioner to the membrane. Advantageously a Kapton® adhesive strip is used.

Kapton® is already used for space applications. It satisfies the criteria imposed for space applications. The use of this material makes it possible to pass all the homologation tests to which a new material is subjected in order to be able to be used for these applications.

Moreover, it has the advantage of having the same thermo-elastic behaviour as the membrane that is made of the same material.

In the embodiment of the figures, the tensioners 23 are flexible strips. They are, for example, Kapton® strips. It is also possible to use strips of polyparaphenylene terephthalamide PPD-T.

Dupont de Nemours markets the latter material under the name of Kevlar This material has the advantage of retaining its mechanical properties at extreme temperatures.

In summary, any material having a stiffness and a dimensional stability equivalent to Kapton® and meeting predetermined criteria imposed for a space application can be used.

Strips are chosen that are stiffer than the membrane. Advantageously, strips are chosen that have a stiffness of between 5 N/m and 500 N/m. For example flexible strips having a thickness of between 0.1 mm and 2 mm are chosen.

Advantageously Kapton® strips are chosen that are thicker than the membrane. Advantageously strips are chosen that are between 10 and 20 times thicker than the membrane. For example strips that are 0.38 mm thick are chosen.

The tensioners are arranged relative to the first means 19 for attaching the membrane 18 so that the tensioners 23 rest on the reflector 13 when the membrane 18 is attached to the reflector 13 by means of the attachment means 19, 20. The first attachment means ensure the separation between the tensioners 23 and the border of the membrane 18. By virtue of this arrangement, the tensioners can apply forces $\vec{F}$ which pull the membrane towards the outside of the reflector, that is to say towards space.

If the tensioners 23 are flexible strips flattened onto the membrane, as shown in FIG. 2*b*, the strips 23 are more particularly arranged so that they overlap the joint 24 between the second face 16 of the reflector 13 and the edge 17 when the membrane 18 is attached to the reflector and the strips 23 are designed so that they are in flexion over the whole predetermined temperature range.

Thus, when the membrane is attached to the reflector 13, each strip 23, because of its dimensions and its arrangement, produces a force $\vec{F}$ which pulls the membrane 18 towards the outside of the reflector 13 so as to stretch the membrane. This force is applied irrespective of the temperature to which the reflection device is subjected provided that it is in the predetermined temperature range.

The tensioners 23 are distributed over the periphery of the membrane 18 so that the membrane 18 forms a substantially flat surface between space and the first face 15 when the membrane 18 is attached to the reflector 13.

Obtaining a membrane 18 forming a substantially flat surface requires precise positioning of the tensioners 23 relative to the reflector. The precision of the positioning is obtained notably by carefully arranging the tensioners 23 relative to the first attachment means 19, 20. This operation is awkward. It is carried out directly on the membrane before the latter is attached to the reflector. The operation consisting in making the first attachment means 19 and the second attachment means 20 interact is easy. It does not require the taking of particular precautions in order to ensure a precise positioning of the membrane. The precision operations have already been carried out on the membrane.

Preferably, as shown in FIGS. 2*a* and 2*b*, the strips are flattened against the membrane. The fact of flattening the strips 23 against the membrane ensures that the strips are placed in the position that is desired when the membrane is attached to the reflector.

In the embodiment of FIG. 2*b*, the tensioners are set back relative to the first face 15. The membrane is resting on the periphery of the active face 15.

As a variant, the tensioners are arranged so as to keep the membrane at a distance from the first face of the reflector at every point on this face. In other words, the tensioners 23 are arranged so as to apply an additional force to the membrane in the direction perpendicular to the force $\vec{F}$ towards space so as to keep the membrane 18 away from the first face 15 of the reflector 13 at every point on the said first face 15.

For example, the strips are arranged so that they have a border extending closer to space than the first face 15.

This feature makes it possible to stretch the membrane in a plane which is adjacent at no point to the first face of the reflector, even to its periphery.

Note that all that has been described above can be applied by replacing the reflector with another item of transmitting equipment of the panel type for radiating radio waves having a first active face, radiating radio waves, and an inactive face, the said faces being connected by an edge.

The arrangement of the strips so as to keep the membrane 18 away from the first active face at every point of the said active face is particularly advantageous when the item of transmitting equipment is a flat transmitting panel, for example a flat radiating panel is flat. It makes it possible to ensure the spacing between the membrane and the first face of the reflector.

Figure 3:
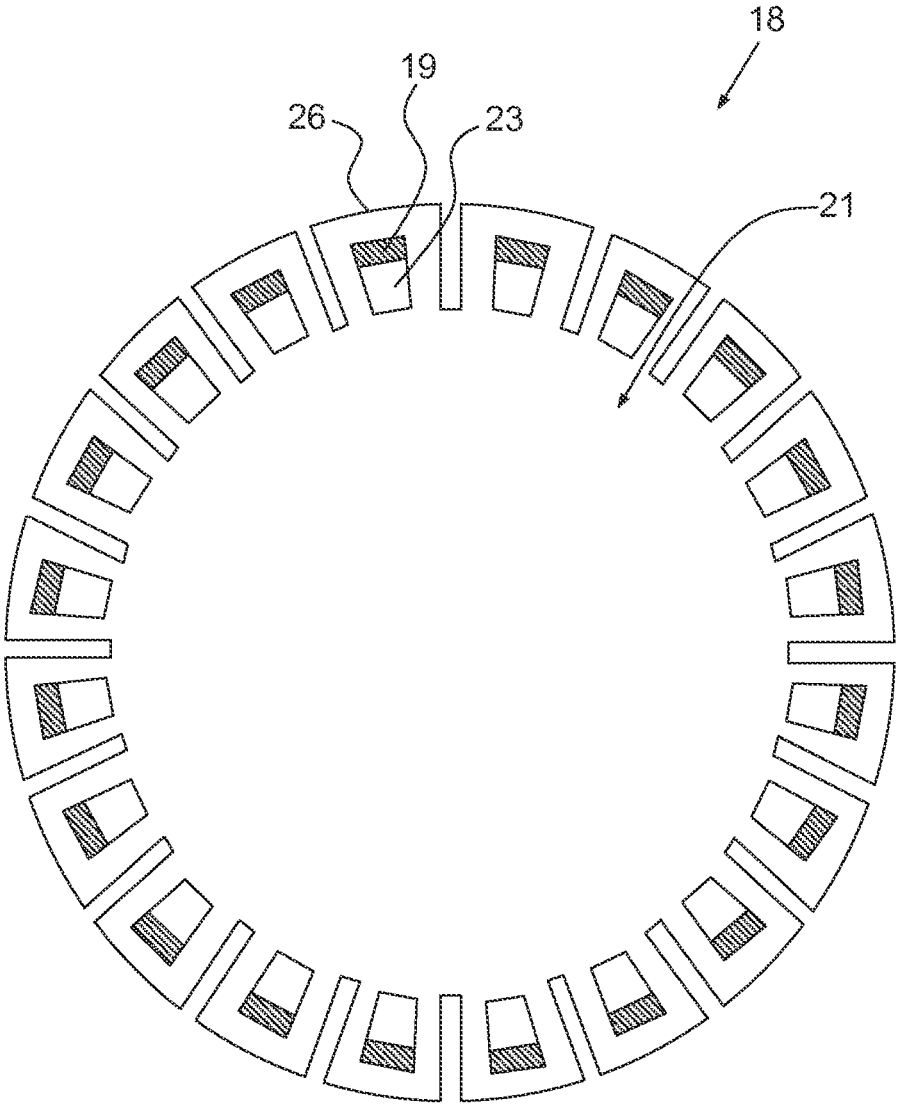
FIG. 3 represents schematically the inner face of the membrane.

As shown in FIG. 3, the membrane 18 has, on its periphery, tongues 26 of which only one has been given a reference number for increased clarity. These tongues 26 are distributed in the shape of flower petals around the periphery of the membrane. In other words, the periphery of the membrane 21 is cut out in the shape of flower petals.

The first attachment means 19 are arranged on these tongues 26 so that, when the membrane 18 is bonded to the reflector 13, they interact with the second attachment means 20.

A further subject of the invention is a method for manufacturing a reflection device 12 according to the invention. This method comprises: a step consisting in fitting the membrane 18 with elastic tensioners 23 designed to hold the membrane 18 stretched between the first face 15 of the item of transmitting equipment and space, irrespective of the thermal expansions of the membrane 18 and of the item of transmitting equipment 13 that occur in a predetermined temperature range, when the attachment means attach the membrane 18 to the said item of transmitting equipment 13; and, a step of attaching the membrane 18 furnished with the elastic tensioners 23 to the item of transmitting equipment 13.

This method is of greater value industrially than the manufacturing method of the prior art because it does not require a step of attaching elastic tensioners to the membrane which limits the duration of the immobilization of the item of transmitting equipment. Moreover, since the tensioners are arranged on the membrane to obtain the desired effect, the step of attaching the membrane is easy.

The invention also relates to a spacecraft, for example, a satellite, comprising a telecommunications antenna comprising a device according to the invention.

The invention claimed is:

1. A device for transmitting radio waves, comprising:

an item of transmitting equipment for a telecommunications antenna, a membrane for thermally protecting a reflector, and means for attaching the thermal protection membrane to the item of equipment, wherein the thermal protection membrane is furnished with a plurality of elastic tensioners designed to keep the thermal protection membrane stretched between a first active face of the item of transmitting equipment and space, irrespective of the thermal expansions of the membrane and the item of transmitting equipment occurs in a predetermined temperature range, when the attachment means attach the membrane to the said item of transmitting equipment, said elastic tensioners comprising flexible strips having a stiffness greater than the stiffness of the membrane, said strips being flattened against the membrane and being attached to the membrane.

2. A device according to claim 1, the means for attaching the membrane further comprise first attachment means secured to the membrane ensuring separation between the tensioners and the edge of the membrane in order to ensure contact between the item of transmitting equipment and the tensioners when the attachment means attach the membrane to the said item of transmitting equipment.

3. A device according to claim 1, wherein the attachment means comprise second attachment means attached to a second inactive face of the item of transmitting equipment and are designed to interact with the first attachment means in order to attach the membrane to the item of transmitting equipment.

4. A device according to claim 1, wherein the flexible strips have a stiffness of between 5 N/m and 500 N/m.

5. A device according to claim 1, wherein the flexible strips are made of polyparaphenylene terephthalamide PPD-T or polyimide.

6. A device according to claim 5, wherein the predetermined temperature range extends from −250° C. to +400° C.

7. A device according to claim 1, wherein the flexible strips have a thickness of between 0.1 mm and 2 mm.

8. A device according to claim 1, wherein the flexible strips are polyimide film strips that are 10 to 20 times thicker than the membrane.

9. A device according to claim 1, wherein the flexible strips are arranged so that they overlap on the joint between a second inactive face of the panel and an edge joining the first active face and the second inactive face of the item of transmitting equipment when the attachment means attach the membrane to said item of transmitting equipment, the strips also being designed so that they are in flexion over the whole predetermined temperature range.

10. A device according to claim 1, wherein the elastic tensioners are arranged so as to exert an additional force on the membrane in the direction perpendicular to the force and in the direction of space so as to keep the membrane spaced from the first active face of the item of transmitting equipment at every point of the said first active face.

11. An antenna comprising a device according to claim 1.

12. A spacecraft comprising an antenna according to claim 11.

13. A method for manufacturing a device for reflecting radio waves according to claim 1, comprising:

fitting the membrane with elastic tensioners designed to hold the membrane stretched between the first face of the item of transmitting equipment and space, irrespective of the thermal expansions of the membrane and of the item of transmitting equipment that occur in a predetermined temperature range, when the attachment means attach the membrane to said item of transmitting equipment, said elastic tensioners comprising flexible strips being stiffer than the stiffness of the membrane, the said flexible strips being flattened against the membrane and attached to the membrane, and attaching the membrane furnished with the elastic tensioners to the item of transmitting equipment.

* * * * *